US006910448B2

(12) United States Patent
Thoma

(10) Patent No.: US 6,910,448 B2
(45) Date of Patent: Jun. 28, 2005

(54) APPARATUS AND METHOD FOR HEATING FLUIDS

(76) Inventor: Christian Thoma, Chalet Abaco, Green Road, St. Clement, Jersey (GB), JE2 6QA ( * ) Notice: Subject to any disclaimer, the term of this patent is extended or adjusted under 35 U.S.C. 154(b) by 0 days.

(21) Appl. No.: 10/612,980

(22) Filed: Jul. 7, 2003

(65) Prior Publication Data

US 2005/0051111 A1 Mar. 10, 2005

(51) Int. Cl.[7] ..... F22B 3/06
(52) U.S. Cl. ..... 122/26; 126/247; 237/12.3 R
(58) Field of Search ..... 122/26; 237/12.3 R; 126/247

(56) References Cited

U.S. PATENT DOCUMENTS

| | | | | |
|---|---|---|---|---|
| 1,149,938 A | | 8/1915 | Nagelvoort | |
| 3,791,349 A | | 2/1974 | Schaefer | |
| 4,424,797 A | | 1/1984 | Perkins | |
| 4,779,575 A | * | 10/1988 | Perkins | 122/26 |
| 5,188,090 A | | 2/1993 | Griggs | |
| 5,392,737 A | | 2/1995 | Newman, Sr. et al. | |
| 5,552,133 A | | 9/1996 | Lambert et al. | |
| 5,881,953 A | * | 3/1999 | Moroi et al. | 237/12.3 R |
| 5,913,306 A | | 6/1999 | Moroi et al. | |
| 5,915,341 A | * | 6/1999 | Moroi et al. | 122/26 |
| 6,371,381 B1 | * | 4/2002 | Niwa et al. | 237/12.3 R |
| 6,386,751 B1 | | 5/2002 | Wootan et al. | |
| 6,595,759 B2 | * | 7/2003 | Crosta et al. | 417/63 |
| 6,627,784 B2 | | 9/2003 | Hudson et al. | |

FOREIGN PATENT DOCUMENTS

| | | |
|---|---|---|
| DE | 33 27 137 | 2/1984 |
| GB | 1 217 959 | 1/1971 |
| GB | 2 143 632 | 2/1985 |
| JP | 55-102491 | 8/1980 |
| JP | 60-8391 | 1/1985 |
| JP | 60-226594 | 11/1985 |
| JP | 62-213895 | 9/1987 |
| WO | WO 94/11096 | 5/1994 |
| WO | WO 99/11478 | 3/1999 |

* cited by examiner

*Primary Examiner*—Gregory Wilson
(74) *Attorney, Agent, or Firm*—Young & Thompson

(57) ABSTRACT

A fluid heating apparatus has a housing with a main chamber in which a rotor is situated. A drive shaft drives the rotor about a longitudinal axis of rotation. The housing has a fluid inlet and a fluid outlet, the fluid outlet communicating with an inlet region and the fluid outlet communicating with an exit region. The outer surface of the rotor forms one boundary for the fluid heat generating region and is confronted by the inner surface of the main chamber which is the other boundary. The fluid inlet is positioned closer to the longitudinal axis of the machine as compared to the fluid exit. The rotor is provided with at least one array of cavitation-inducing holes. Preferably, several rows of holes are configured on the rotor surface, some of which may have a depth dimension extending the radial width of the rotor.

42 Claims, 15 Drawing Sheets

FIG. 14
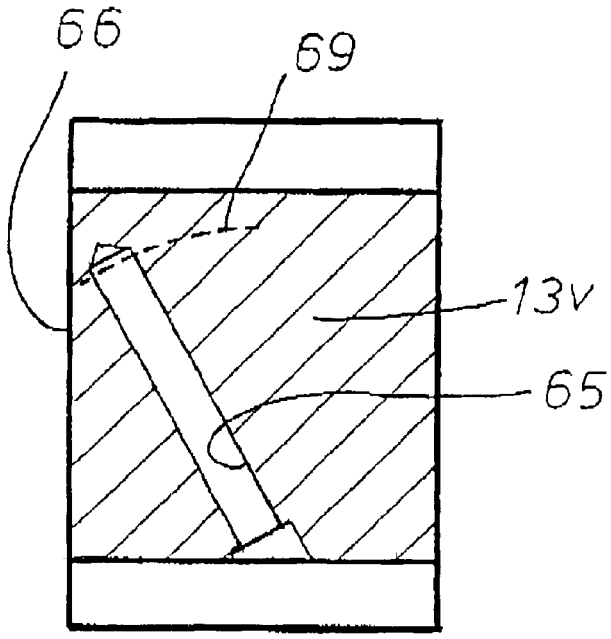
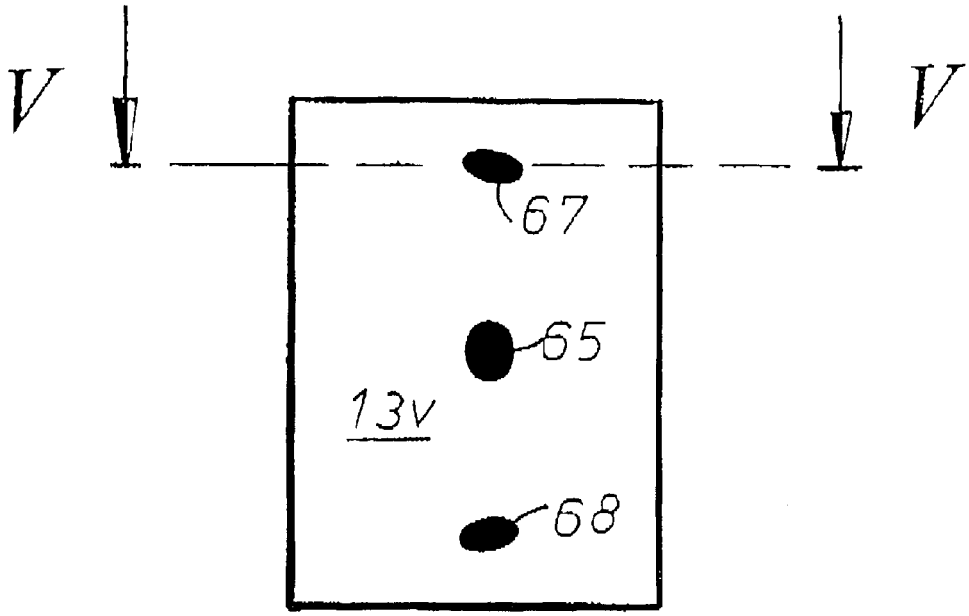
FIG. 13

APPARATUS AND METHOD FOR HEATING FLUIDS

This application corresponds to the British application filed in the UK Patent Office on Jul. 3, 2003 in the name of the same inventor and having the same title, the entirety of which British application, including the drawings thereof, is hereby expressly incorporated by reference herein.

BACKGROUND OF THE INVENTION

The invention relates generally to the heating of liquids, and specifically to those devices wherein rotating elements are employed to generate heat in the liquid passing through them.

Of the various configurations that have been tried in the past, types employing rotors or other rotating members are known, one being the Perkins liquid heating apparatus disclosed in U.S. Pat. No. 4,424,797. Perkins employs a rotating cylindrical rotor inside a static housing and where fluid entering at one end of the housing navigates through the annular clearance existing between the rotor and the housing to exit the housing at the opposite end. The fluid is arranged to navigate this annular clearance between static and non-static fluid boundary guiding surfaces, and Perkins relies principally on the shearing effect in the liquid, causing it to heat up.

An example of a frictional method for producing heat for warming a fluid is the Newman apparatus disclosed in U.S. Pat. No. 5,392,737. Newman employs conical friction surfaces in order to generate heat, the generated heat passing into a fluid reservoir surrounding the internal elements of the device, and where the friction surfaces are engaged together by a spring and adjustment in the compression of the spring controls the amount of frictional rubbing that takes place.

Such prior attempts at producing heat have suffered for a variety of reasons, for instance, poor performance during operation, and the requirement of complicated and expensive components. Scale build-up is another cost factor should subsequent tear down and refurbishment be then needed. Similarly, because friction materials eventually wear out, they must from time-to-time be replaced.

A modern day successor to Perkins is shown in U.S. Pat. No. 5,188,090 to James Griggs. Like Perkins, the Griggs machine employs a rotating cylindrical rotor inside a static housing and where fluid entering at one end of the housing navigates past the annular clearance existing between the rotor and the housing to exit the housing at the opposite end. The device of Griggs has been demonstrated to be an effective apparatus for the heating of water and is unusual in that it employs a number of surface irregularities on the cylindrical surface of the rotor. Such surface irregularities on the rotor seem to produce an effect quite different than the aforementioned fluid shearing of the Perkins machine, and which Griggs calls hydrodynamically induced cavitation. Also known as the phenomena of water hammer in pipes, the ability of being able to create harmless cavitation implosions inside a machine without causing the premature destruction of the machine is paramount. These surface irregularities in Griggs are in the form of radially drilled holes over the length of the cylindrical rotor. The Griggs machine has been shown to work well and is currently known to be used in a number of applications. However, the manufacture of the rotor takes a disproportionate amount of workshop time, due almost entirely due to the time taken to drill so many radial holes. Were it possible to have fewer holes in the rotor, a worthwhile advantage would be gained.

An important consideration, especially in Griggs, is the protection of bearings and seals against deterioration caused by high temperatures and pressures in the fluid entering and exiting the machine. In the case of Griggs, separate detachable bearing/seal units are deployed, externally attached to the main housing surrounding the rotor in order to space the bearing and seal members well away from the clearance surrounding the rotor. The requirement for such detachable bearing/seal units may increase expense and complication and there therefore is a need for a new solution whereby the effects of high temperatures and pressures are less harmful to such bearings and seals.

The present invention seeks to alleviate or overcome some or all of the above mentioned disadvantages of earlier machines, in a device that is relatively simple to implement, preferably with fewer component parts, and or requiring fewer machining operations. For certain applications, there may be advantage through the deployment of deeper holes in the rotor, as compared to the depth of holes taught by Griggs, for improved shock wave transmissions from the cavitation implosion zones to maximum power efficiency in performance. As well as by keeping complication to a minimum and avoiding expensive and time-consuming machining operations, there would be further advantage if the occurrence of the cavitational effect on the liquid through water hammer could be generated in openings that are cast in the rotor rather than machined conventionally, or whereby other changes can be incorporated in the rotor to compensate for having fewer holes.

SUMMARY OF THE INVENTION

It is therefore an object of the present invention to provide a new and improved mechanical heat generator and method of generating heat that addresses the above needs.

A principal object of the present invention is to provide a novel form of water heater steam generator apparatus capable of producing heat at a high yield with reference to the energy input. It is a still further object of the invention to provide a method for doing so.

It is a still further object of the invention to alleviate or overcome some or all of the above described disadvantages of earlier devices for generating an improved shock wave by the cavitation implosion zones to maximum power efficiency in performance.

It is therefore a preferred feature of the invention that the entry point for the fluid entering the machine, is close to the center coincident with the axis of rotation of the rotor. The fluid, on entering the central chamber of the machine and coming into contact with the revolving rotor, is rapidly propelled radially outwards in a generally spiral path, until redirected by the interior shape of the housing to enter the annular clearance between rotor and housing. Although some heating of the fluid is likely to occur naturally in the annular clearance, due to the shearing effect on the fluid between static and dynamic opposing boundary surfaces, the amount of heat created this way is likely to be quite small. Without the formation of a number openings or depressions formed o n the rotor surface, the fluid would ride through the annular clearance without any influence from cavitation or the effect of water hammer taking place.

It is therefore an important feature of this invention to include the deployment of numerous openings or cavitation inducing depression zones on at least the surface of the rotor, deployed preferably, over several rows along this surface. Although it is a preferable feature of this invention to position a peripheral exit passage in the housing for the heated fluid in a location radially outwardly of the annular clearance, the exit passage may alternatively be positioned radially inwardly of the annular clearance to be adjacent the flanking wall of the rotor. With respect to Griggs, the fluid enters and exits the internal chamber are both positioned radially inwards of the annular heat generating working chamber, and it should be noted that many of the features of this invention may still be used to good effect were the entry and exit passages positioned as in Griggs.

As the fluid rides over each opening or depression zone in turn, it is squeezed and expanded by the vacuum pressure conditions occurring in the zone, and the condition of cavitation together with accompanying shock wave behaviour as it traverses across the surface of the rotor liberates a release of heat energy into the fluid. Although natural forces such as cavitation vortices are known to occur in nature, the forces to be generated in the present invention are usually viewed as an undesirable consequence in man-made appliances. Such destructive forces, in the form of cavitation bubbles of vacuum pressure, are purposely arranged to implode within locations in the device where they can do no destructive harm to the structure or material integrity of the machine. In this respect, this invention discloses the use of openings or depression zone in the form of holes of different depths and angles towards broadening the occurrence in the number and range of resonant frequencies for an additional influence in the formation of cavitation bubbles. In another respect, certain rotor types are disclosed with a minimum number of deep drilled holes per row. In the most extreme case in this regard, the present invention also describes a rotor manufactured as a casting. A cast rotor has the advantage over fully machined rotors in that the generally time consuming, and therefore most costly, drilling operations normally required for such holes, operating as openings or depression zones in the rotor, are eliminated. By casting, the shapes for the openings or depression zones can be included.

It is an aspect of this invention to be able to rapidly and successively alter and disrupt the path of fluid flowing between the rotating and stationary elements in the annular clearance, such that the deployment of openings or depression zones on the surface of the rotor acts to divert a quantity of the passing fluid into said openings or depression zones for the formation of cavitation vortices and their attendant shock waves and water hammer effects. The fluid once subjected to water hammer returns back to the annular passage with an increase in temperature and this continues in a continuous process until the fluid eventually reaches the exit passageway of the device. As such, each of said openings or depression zones becomes in effect individual heating chambers for the device. For certain applications, some or all of such individual heating chambers may be deeper in depth than deployed previously for the creation of an amplified cavitational effect by the device.

In one form thereof, the invention is embodied as an apparatus for heating of a liquid such as water, comprising a static housing having a main chamber. A central member is located in the chamber and provided with an outer surface and the chamber is provided with an inner surface radially spaced apart such that these surfaces confront each other without touching so thereby defining an annular fluid volume between them. A fluid inlet is arranged to communicate with the annular fluid volume nearer one end of the chamber and where a quid outlet is arranged to communicate with the annular fluid volume nearer the opposite end of the chamber. These surfaces may be positioned to be parallel with respect of the longitudinal axis of the machine or alternatively, at least one of these surfaces may be angularly inclined with respect to this axis. A drive shaft having a longitudinal axis of rotation rotatably supported in said housing and drivingly connected to said rotor for imparting mechanical energy to said rotor assembly. The fluid inlet connection is preferably disposed near to said longitudinal axis whereas the fluid outlet connection is preferably disposed radially outwardly of said rotor. Rotation of said rotor acts in causing fluid to move outwardly from said fluid inlet connection and the fluid traverses across and along the annular clearance towards the fluid outlet connection, and wherein said rotor includes a series of openings, preferably arranged in rows, facing towards the surrounding interior surface of the chamber formed by the housing, and the fluid, as it passes a multitude of cavitation implosion cavities is caused to heat up during its transit.

Mains water pressure or the source tank be situated above the height of the device can be used to provide the device with water at the inlet connection.

Other and further important objects and advantages will become apparent from the disclosures set out in the following specification and accompanying drawings.

BRIEF DESCRIPTION OF THE DRAWINGS

The above mentioned and other novel features and objects of the invention, and the manner of attaining them, may be performed in various ways and will now be described by way of examples with reference to the accompanying drawings, in which:

FIG. 13 is a plane view of a modified rotor having a single row having holes drilled at an oblique angle.

FIG. 14 is a sectional view at V—V in FIG. 13 showing one of the four deeply drilled holes is angled towards one end of the rotor.

DETAILED DESCRIPTION OF THE FIRST ILLUSTRATIVE EMBODIMENT OF THE INVENTION

Figure 1:
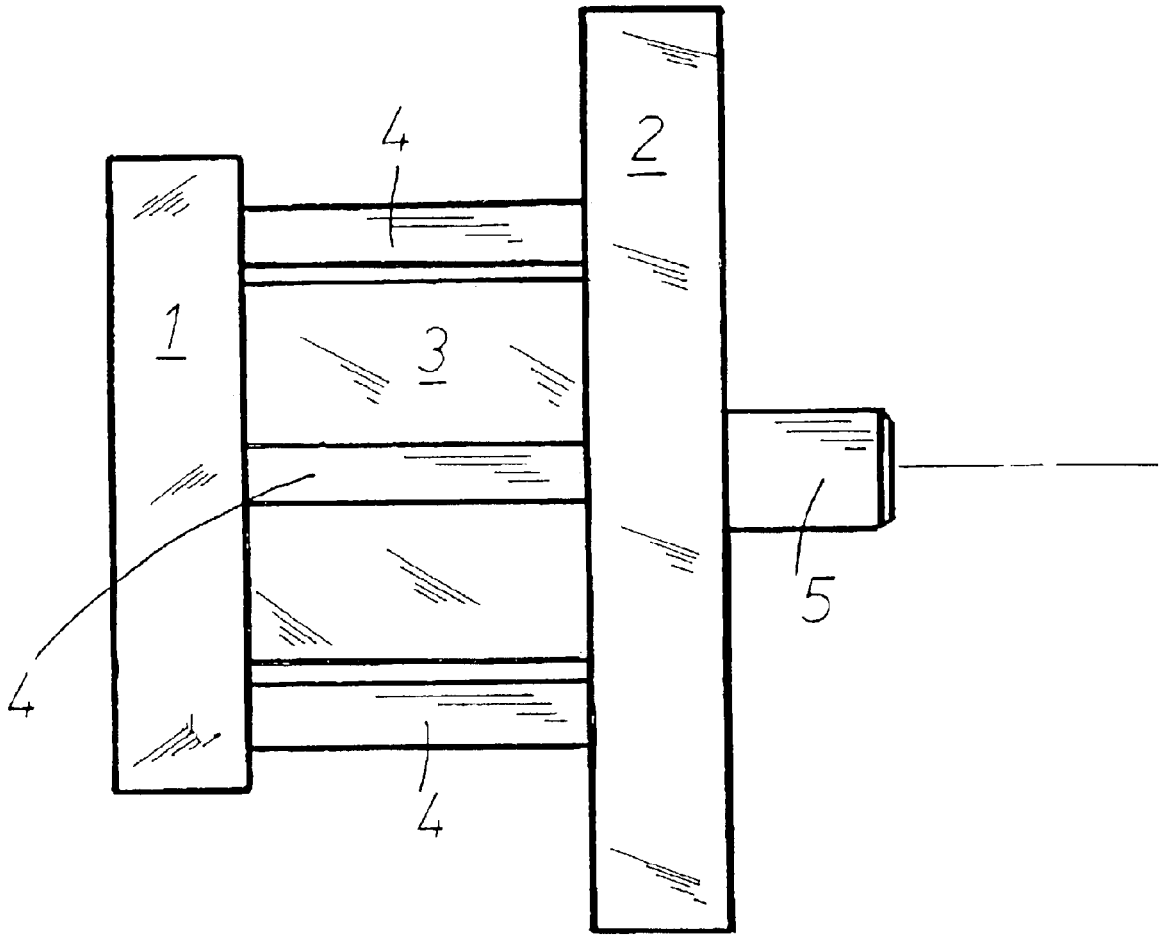
FIG. 1 is a longitudinal exterior view of the heat generating device in according to the present invention.
Figure 2:
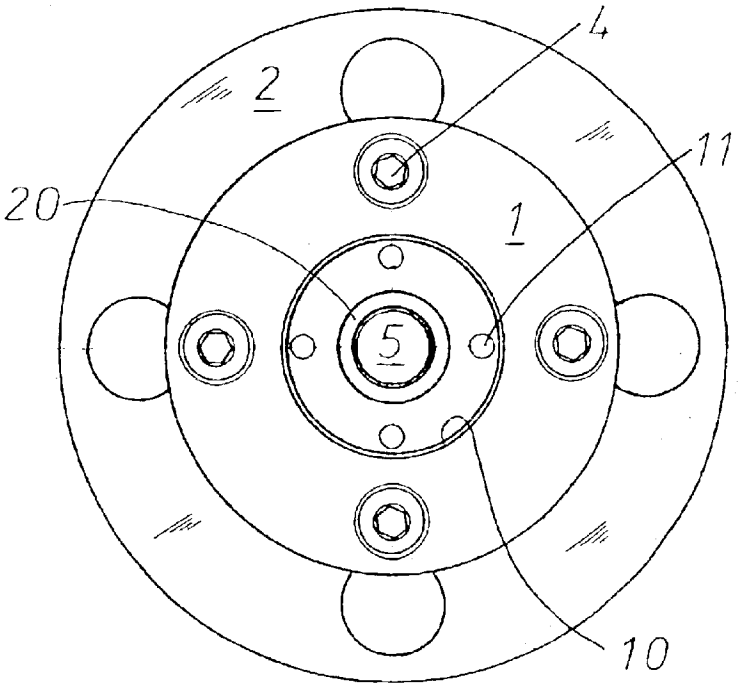
FIG. 2 is an exterior end view of the heat generating device taken on the left side of FIG. 1.

Referring to FIGS. 1 and 2, the external appearance of device shows a housing structure comprising three elements: a rear housing member 1; a front housing member 2; a central sleeve housing member 3; and where four screws 4 are arranged to engage members 1, 2 together with member 3 thereby sandwiched in between. Drive shaft 5 is shown protruding out from front housing member 2 in FIG. 1. The rear view of housing member 1 in FIG. 2 shows threaded fluid intake connection 10 and well as four fluid ports 11 which become more clearly depicted with reference to FIG. 3. The threaded fluid intake connection 10 is shown rather in diameter in order for access to be obtained for a drill in order that fluid ports 11 can be created. Later embodiments show alternative porting in place of fluid ports 11 depicted here, and could if so deemed employ intakes of considerably smaller diametric sizing.

Figure 3:
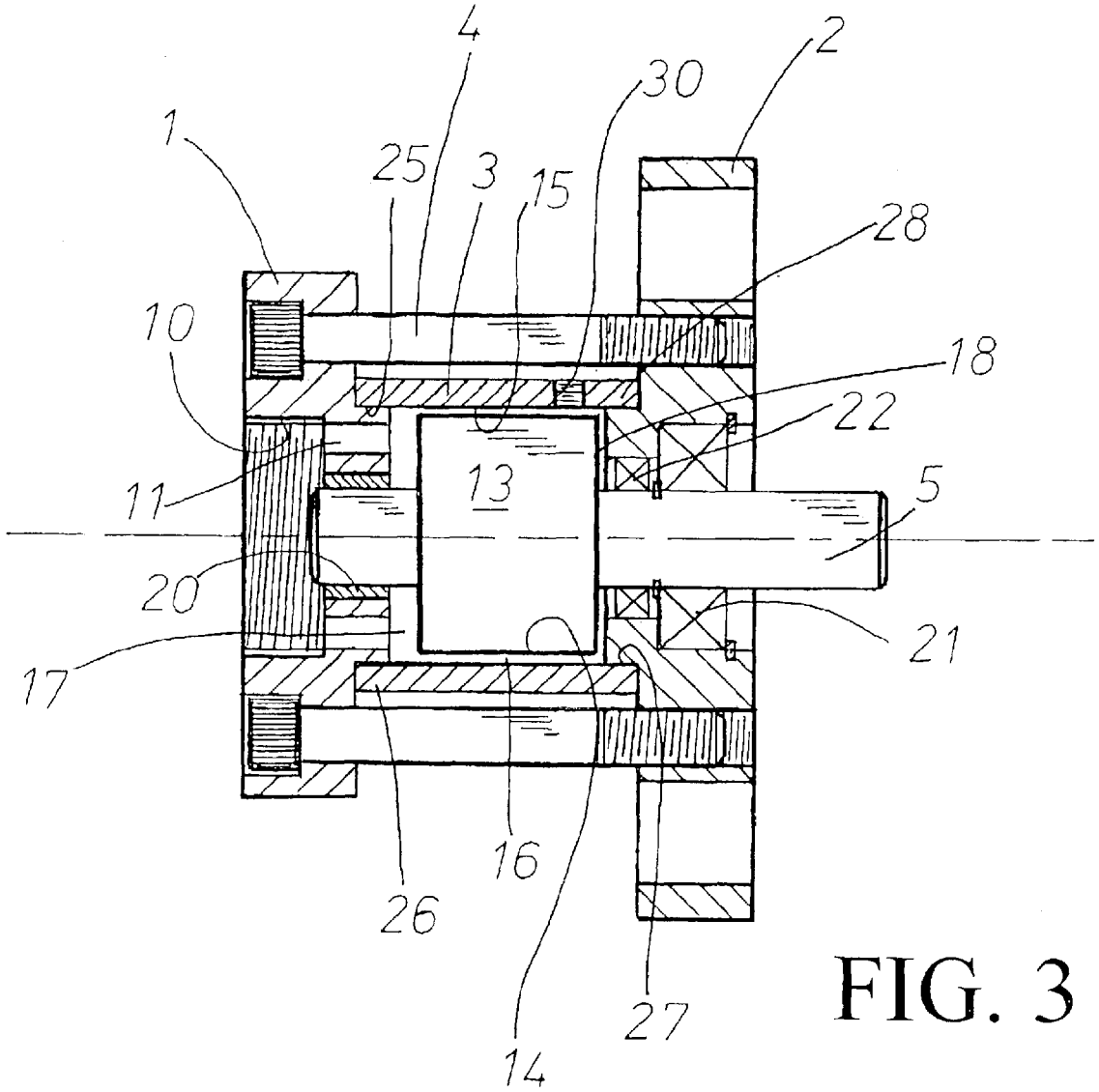
FIG. 3 is a longitudinal sectional view of the heat generating device of FIG. 1 according to the first embodiment of the present invention deploying a rotor where the openings or depression zones are omitted.

The interior of the heat generating device an internal chamber largely occupied by a rotor 13 as shown in FIG. 3., and where the rotor is fixed to drive-shaft 5. The rotor 13 depicted here has a plain outer surface with no surface detail. The outer diameter of the rotor 13 shown as 14 is sized accordingly to have a specifically sized working clearance between it and the inner diameter, shown as 15, of the sleeve housing member 3. This annular working clearance, alternatively termed annular fluid volume, is denoted as 16 whereas respective axial clearances denoted as 17, 18, exit as shown in FIG. 3 at each end of rotor 13. Axial clearance volume 17 is shown occupying a greater volume of space, as compared to axial clearance volume 18 at the opposite end of rotor 13, and this allows improved accessibility for fluid entering from ports 11 to reach the entrance of the annular working clearance 16.

Drive-shaft 5 is supported in the housing by a pair of bearings, plain bearing 20 disposed in rear housing member 1 and bearing 21 disposed adjacent rotary seal 22 in front housing member 2. Because plain bearing 20 is positioned close to the fluid entry connection 10, it remains largely unaffected by any heat build-up in other areas of the device. The plain bearing 20 is preferably a steel backed PTFE lead lined composite bearing. Later embodiments of the invention could use a sealed ball bearing in place of plain bearing 20 once the space occupied by ports 11 is freed. As inner end of the drive shaft 5 protrudes towards fluid entry connection 10, unlike Griggs, there is no requirement for sealing the device at this side of the housing. For purposes of convenience, the rotor unit 13 here described is a heat shrink fit on drive shaft 5. However, the rotor and drive-shaft could be manufactured as one-piece out of solid bar or a metal forging, or alternatively, be separate components connected together by a spline or other connecting devices such as a key. Another point of detail is the inclusion of notch 19, shown in FIG. 5 which is shown located in rotor **13*i* but alternatively, could be located on the surface of drive-shaft 5. The notch 19 is of sufficient length to communicate with respective axial clearances 17, 18**.

Rear housing member 1 is provided with a register 25 on which one end 26 of housing sleeve member 3 is engaged, and similarly, front housing member 2 has a similar register 27 on which the opposite end 28 of housing sleeve member 3 is engaged. Sealant or some form of robust sealing device is disposed between these joining surfaces to ensure there is no escape of fluid from the device.

Housing sleeve member 3 is provided with a fluid exit connection 30 which, preferably, is disposed radially outwardly from said rotor 13. All drawing embodiments, including FIG. 3, show respective fluid exit connection 30 in a false position in housing member 3, and in practice the exit connection 30 would be slightly displaced to avoid interference with bolts 4.

Figure 4:
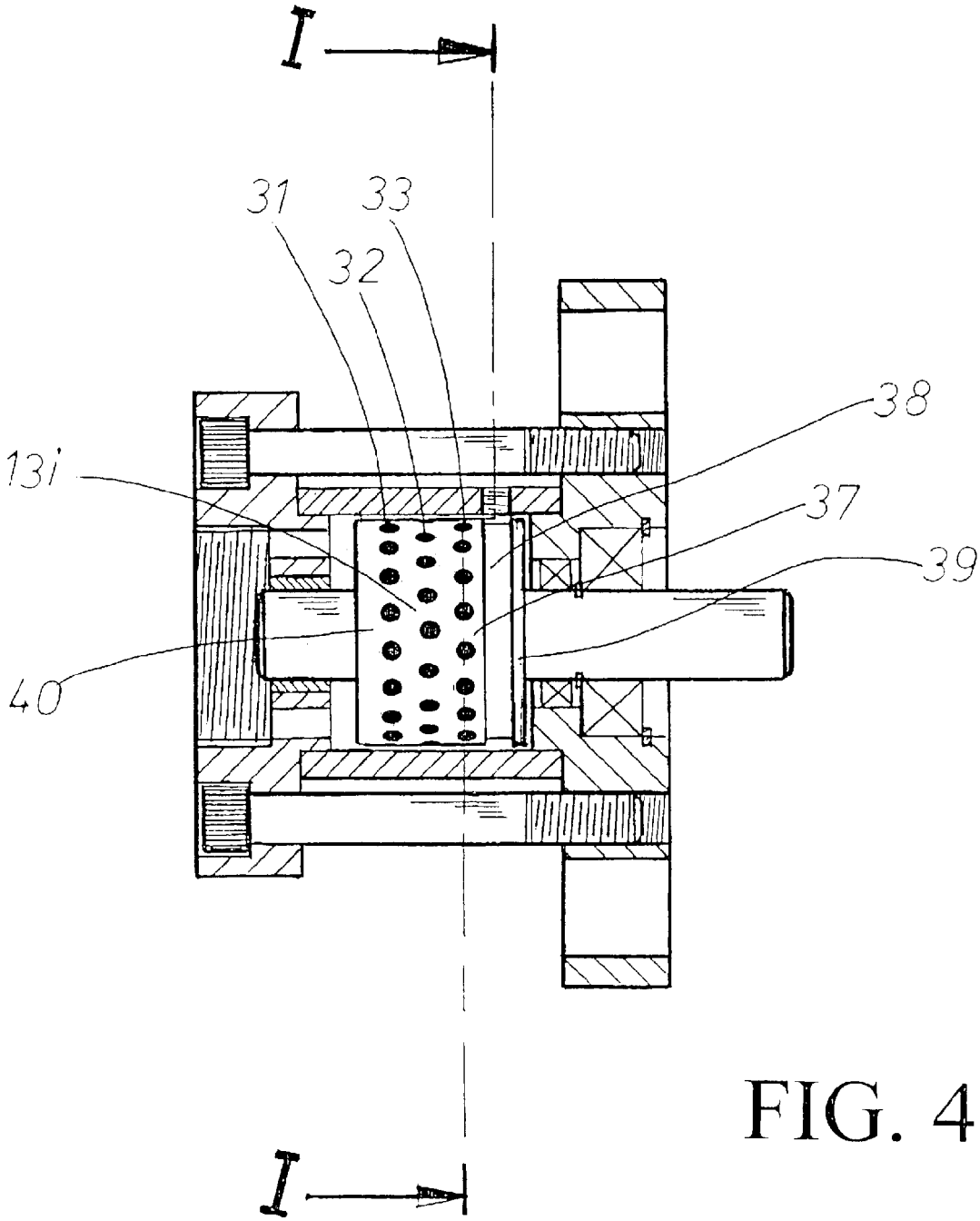
FIG. 4 is a longitudinal sectional view of the heat generating device of FIG. 1. according to the first embodiment of the present invention deploying a rotor where the openings or depression zones are included, the openings or depression zones displayed in the form of drilled holes, said holes being arranged in three rows by way of example.

FIG. 4 depicts a rotor **13*i* formed with a plurality of openings in the form of radial holes arranged in three rows shown as row 31, 32 and 33**. Although three rows are shown, the rotor may on occasion have just a single or double row of holes or for that matter, may have more rows than the three shown.

Figure 5:
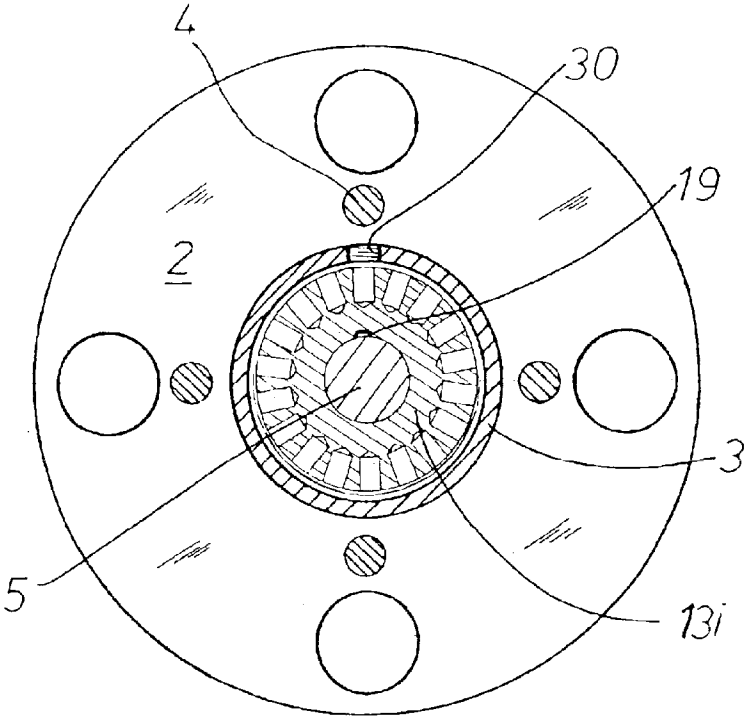
FIG. 5 is a transverse sectional view of the device taken along line I—I in FIG. 4.
Figure 6:
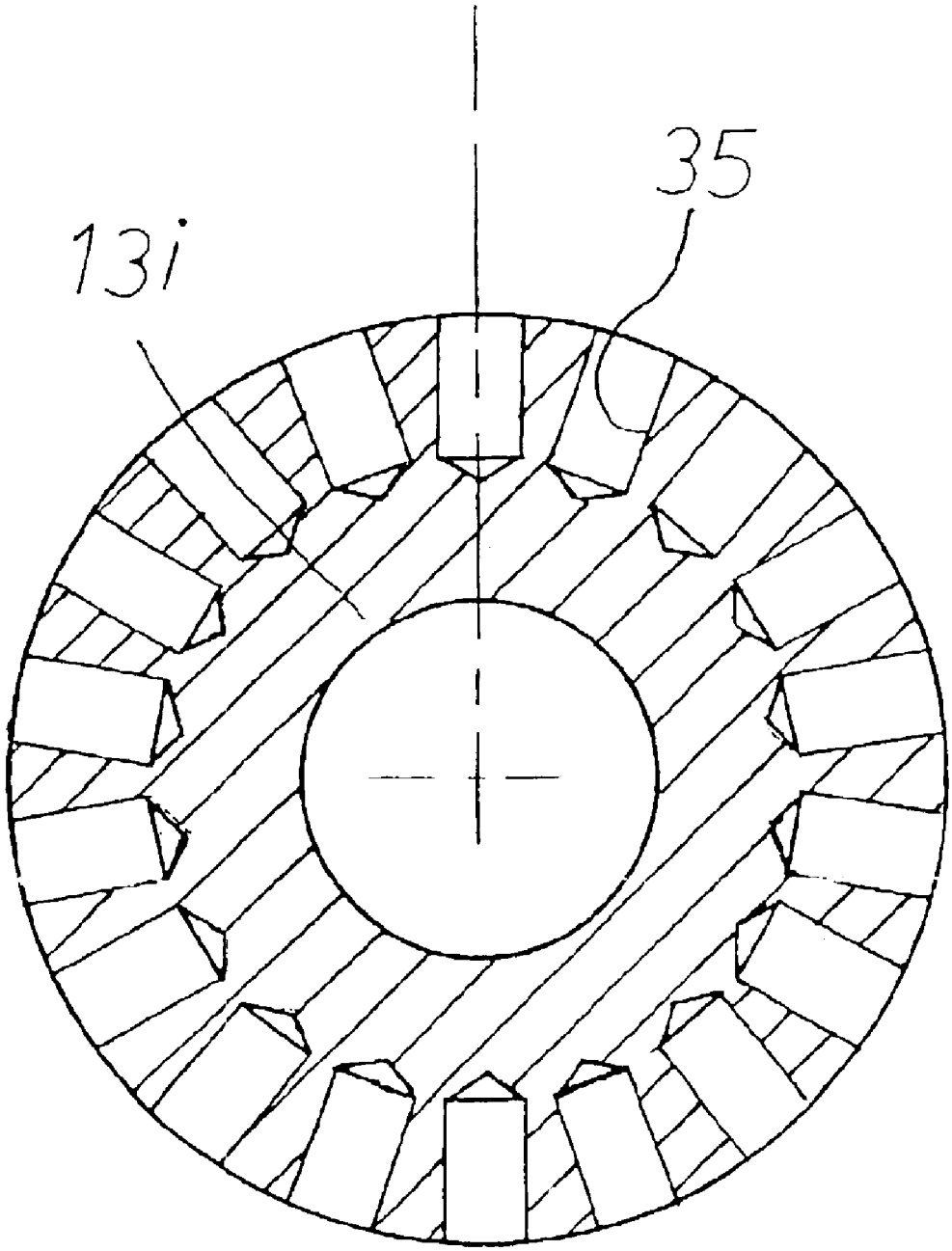
FIG. 6 is exclusively an enlarged view of the section of the rotor of FIG. 5 and where the openings or depression zones are displayed in the form of drilled holes.

FIG. 5 is a section taken at I—I across row 33 in FIG. 4 and depicts individual drilled holed denoted as 35, also shown in the enlarged view of the same rotor **13*i* in FIG. 6. There are eighteen such holes 35 for each respective row in the device, although if so desired, numbers as well as diametric size may be varied in each particular row. However, as in the example shown, the holes in the first and third rows are in-phase whereas the holes in the second row are displaced by ten degrees relative to the position of the holes in the first and third rows. Between the last row of holes, namely row three denoted by numeral 33, a short length of sealing land marked as 37 is shown on the surface of the rotor 13*i* lying adjacent circumferential groove 38**.

Land 37 is important in that it prevents a direct path from holes 35 and groove 38, in other words, the fluid can only travel further along the annular clearance gap before entering groove 38 and exit 30. Therefore, groove 38 operates in the collection of heated liquid once it has creased passing over all the various holes and other, if used, surface detail, in the passage through the annular clearance gap, and groove 38 is positioned to be in-phase with exit passage connection 30. A further short length of sealing land, denoted as 39, on the surface of rotor 13*i*, is provided in order to limit to a small amount any leakage of heated fluid entering axial clearance 18. In this respect, sealing land 39 may be formed as a step on said rotor surface 14 in order to be closer in position to said interior surface 15 of sleeve housing element 3. Depicted also is a short length of sealing land 40 on the surface of rotor 13*i* positioned between axial clearance 17 and the first row of holes 31.

In operation, a prime mover for providing mechanical power to the device, for instance such as an electric motor, drives the device via drive shaft 5, and as a result, rotor 13 rotates at equal speed to said prime mover. Fluid entering the device through inlet 10 is directed through ports 11 to axial clearance 17 from where the general disturbance by the rotating rotor 13 propels the fluid radially outwardly towards entry to the annular clearance gap 16 between rotor circumferential surface 14 and the interior 15 of sleeve housing member 3. As the fluid moves in the annular fluid volume and interacts with the openings/depression zones, shown by the various rows of holes 31, 32, 33, in a direction ultimately towards groove 38, heat-generating cavitation conditions are experienced, and the heat energy imparted in the fluid is outputted from the device as the fluid exits the device through exit connection 30.

The device may be further modified, if required, to allow the substitution for example, of rotary seal 22, by a carbon faced seal ring or a spring loaded silicon carbide face bearing operating directly against the end face of rotor 13.

Although the embodiments described above rely on a circumferential groove 38 formed in the rotor 13 for the collection of the heated liquid or gas about the rotor 13, the groove or similar could alternatively be formed in the interior 15 of the sleeve housing member 3. Alternatively, the device can be adapted to include axial end porting wherein the fluid exit connection would be served by a duct positioned in front housing member 2 and axially adjacent the rotor 13.

FIGS. 7 to 17 disclose a number of alternative forms of hole configuration for the rotor 13 that can be used in place of those holes already described and shown as holes 35 in rotor 13*i* of FIG. 6.

Figure 7:
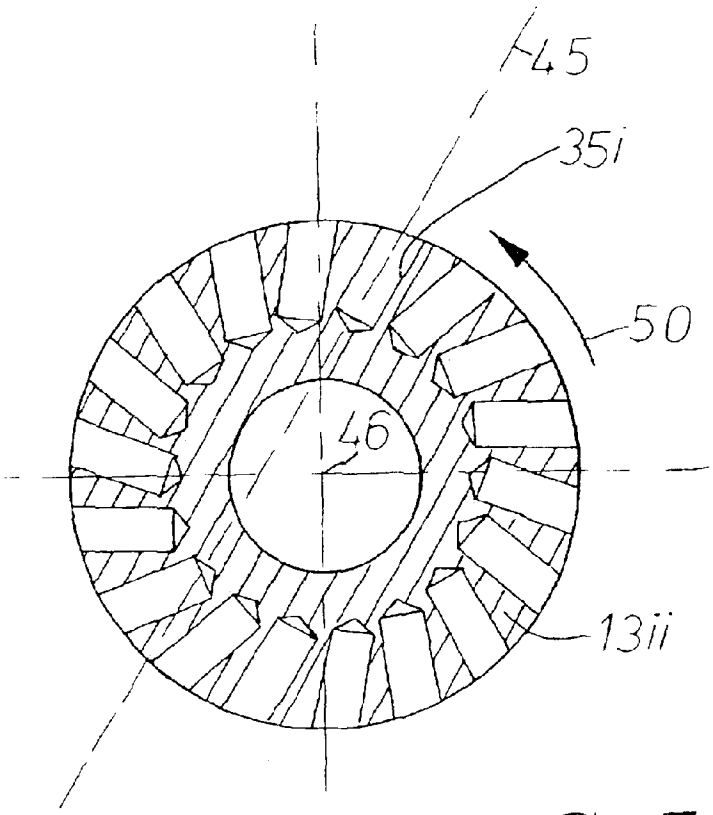
FIG. 7 is exclusively a sectional view for a modified rotor depicting drilled holes which are partially inclined with respect to the center of the rotor.
Figure 8:
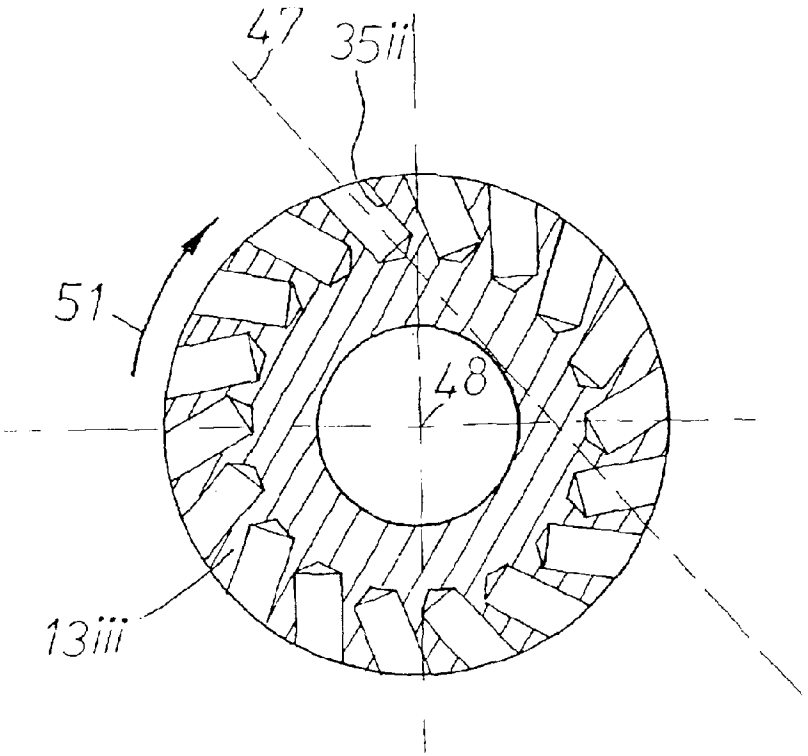
FIG. 8 is exclusively a further sectional view for a modified rotor depicting drilled holes which are more pronouncedly inclined with respect to the center of the rotor.
Figure 9:
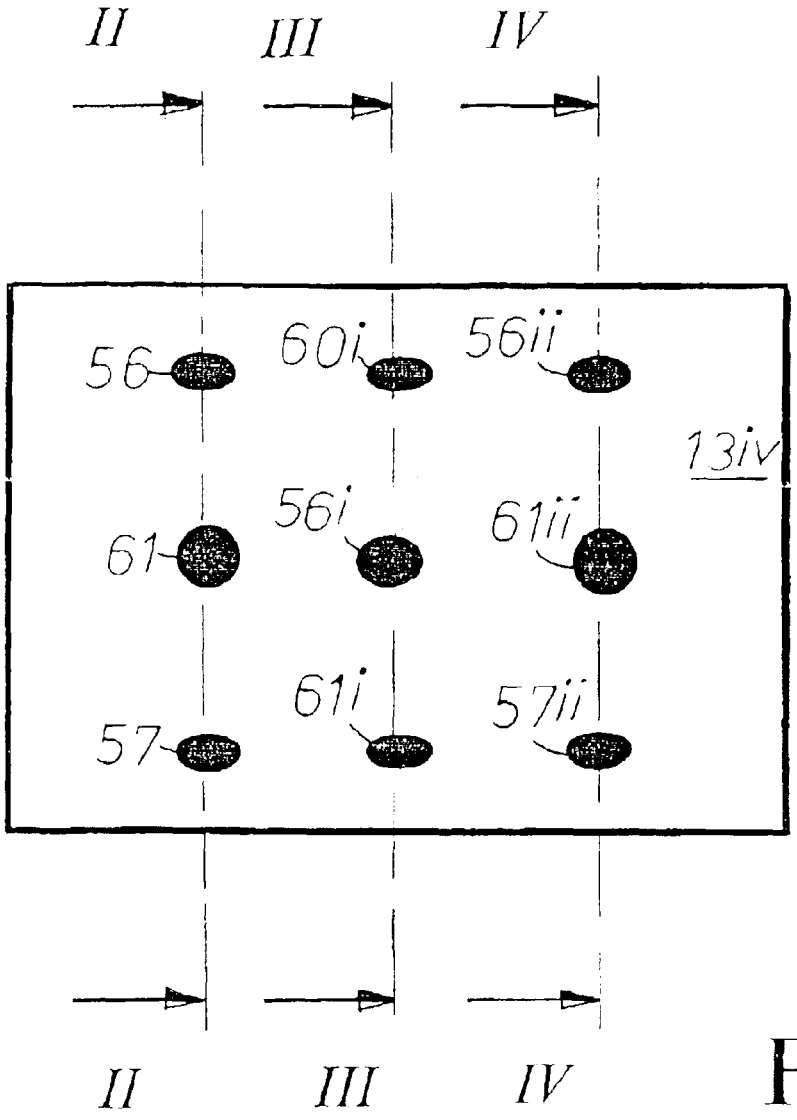
FIG. 9 is a plane view of a modified rotor.

In FIG. 7, holes 35*i* are inclined along axis denoted as 45 with respect to the center of the rotor 13*ii* denoted as numeral 46 and directional rotation of rotor 13*ii* shown by arrow 50. In FIG. 8, holes 35*ii* are more pronouncedly inclined along axis denoted as 47 with respect to the center of the rotor 13*iii* denoted by reference numeral 48 and directional rotation of the rotor 13*ii* shown by arrow 51. For certain operational conditions, the rotational direction of the rotors may be reversed.

It is considered that the angled holes here depicted in both FIGS. 7 and 8 enhance the tendency for cavitation to occur within respective holes, although not strictly analogous, swept wings in supersonic aircraft are a significant advantage during high speed flight.

Figure 11:
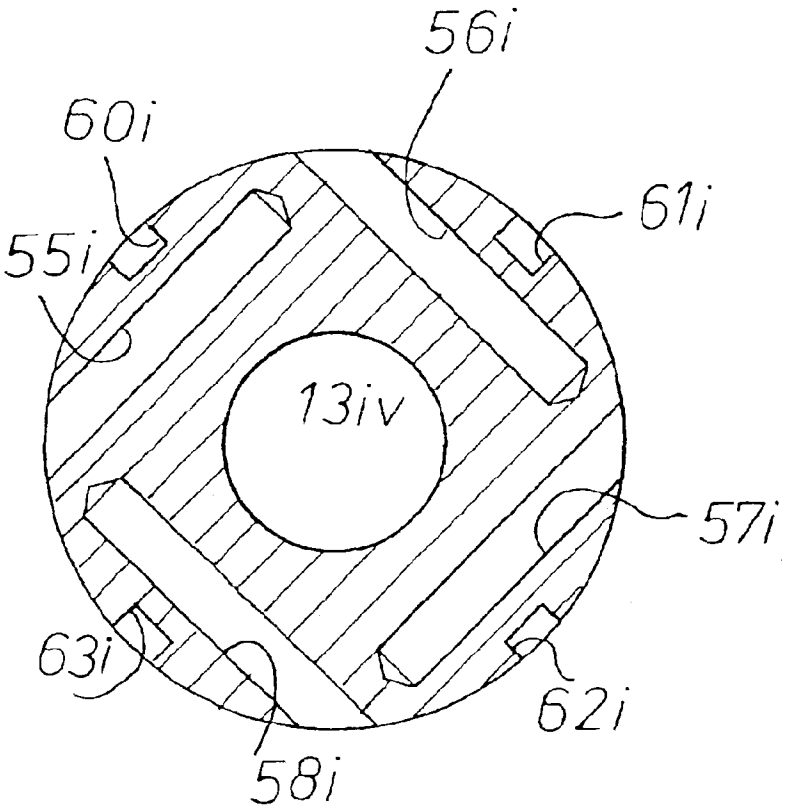
FIG. 11 is a sectional view at section III—III in FIG. 9 depicting a second row of four deeply drilled holes and where each hole is arranged perpendicular to adjacently positioned deeply drilled holes.
Figure 10:
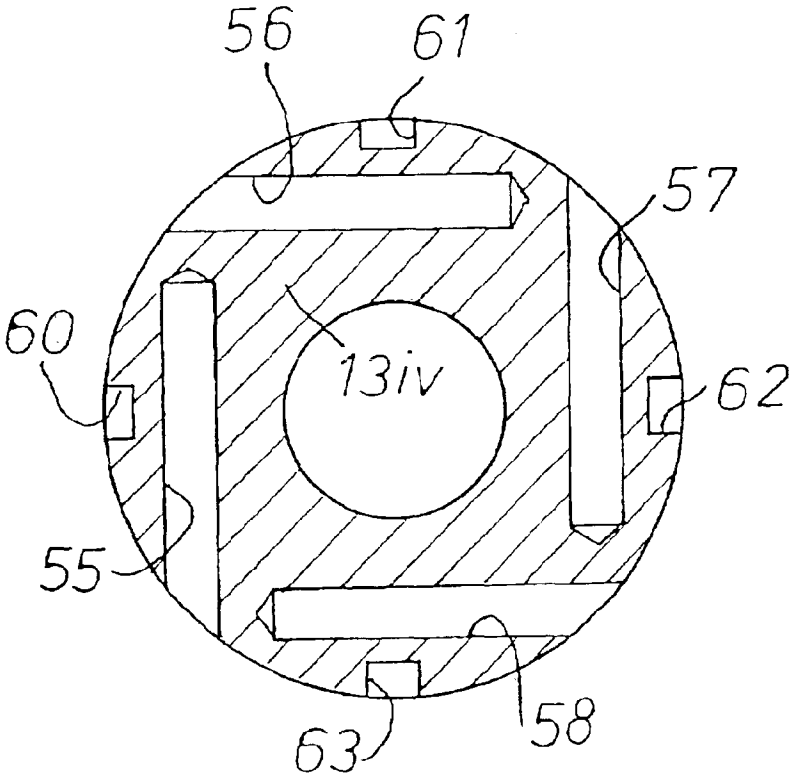
FIG. 10 is a sectional view at section II—II in FIG. 9 depicting a first row of four deeply drilled holes and where each hole is arranged perpendicular to adjacently positioned deeply drilled holes.
Figure 12:
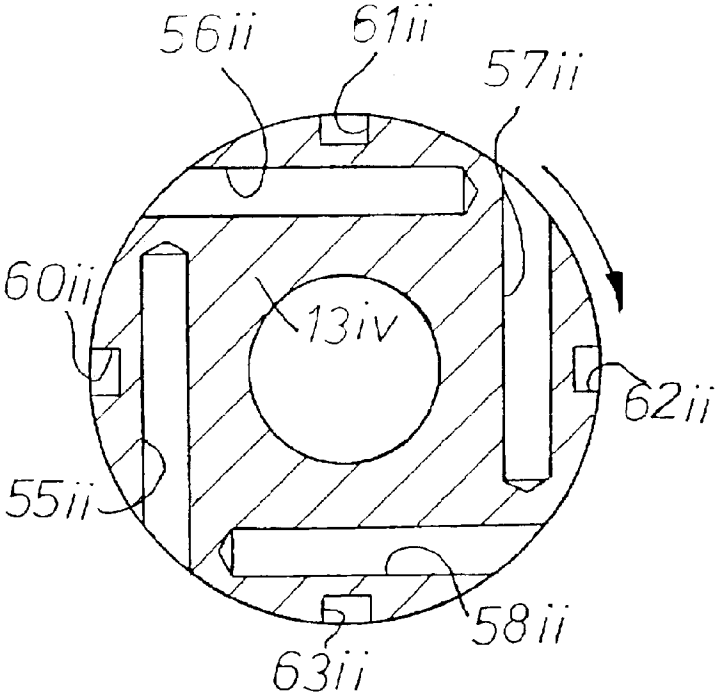
FIG. 12 is a sectional view at section IV—IV in FIG. 9 depicting a third adjacent row of four deeply drilled holes residing adjacent said second row of FIG. 11.

With respect to FIGS. 9 to 12, the modified rotor depicted as 13*iv* is an example of a more economic rotor configuration. This may be achieved specifically by reducing the amount of machining time required to form all the various surface detail on the rotor. As such, whereas earlier rotor embodiments for illustration purposes only were deployed with eighteen holes per row for each rotor, in this modified form of rotor 13*iv*, only four deep drilled holes are required per row. These are shown as holes 55, 56, 57 and 58 in FIG. 10. Preferably four further openings, these being shallow pockets 60, 61, 62 and 63 are also present in the rotor 13*iv* and these are spaced at forty-five degrees to one another and approximately equi-spaced between each of the deeper holes 55, 56, 57, 58, this being the first row of holes in a rotor section. FIG. 11 is a section of rotor 13*iv* taken at the next adjacent row, this being the second row of holes, and here deep holes are denoted as 56*i*, 57*i*, 58*i*, 59*i*, and shallow pockets 60*i*, 61*i*, 62*i*, 63*i*. Similarly, FIG. 12 is a section of the rotor 13*iv* taken at the third row of holes, and here deep holes are denoted as 56*ii*, 57*ii*, 57*ii*, 59*ii* and shallow pockets as 60*ii*, 61*ii*, 62*ii*, 63*ii*.

Note that all holes and shallow pockets in the second row of holes displayed in FIG. 11 are indexed by forty-five degrees with respect to first and third rows of holes and shallow pockets. There may be further or fewer rows of holes if so desired in the configuration chosen for the rotor, this ultimately depending on the given application for the device and this flexibility is of course equally applicable to other embodiments of the present invention.

In FIGS. 13 to 14, a further modified rotor is depicted, this being a single row rotor 13*v*. In the case where four deeply drilled holes are incorporated in this rotor as have already been described for the rotor of FIGS. 9 to 12, in this case these four such deep holes, shown for example as hole 65, have been drilled at oblique angle a direction towards the end 66 of the rotor 13*v*. Shallow pockets 67, 68 are identical to the four shallow pockets 60, 61, 62, 63 present in the rotor 13*iv* of FIGS. 9–12. The deep holes of that earlier rotor were of a depth shown here in FIG. 14 by the dotted line 69. By angling hole 65 towards the end 66 of the rotor 13*v*, it is possible for the hole to be slightly deeper than dotted line 69.

Figure 15:
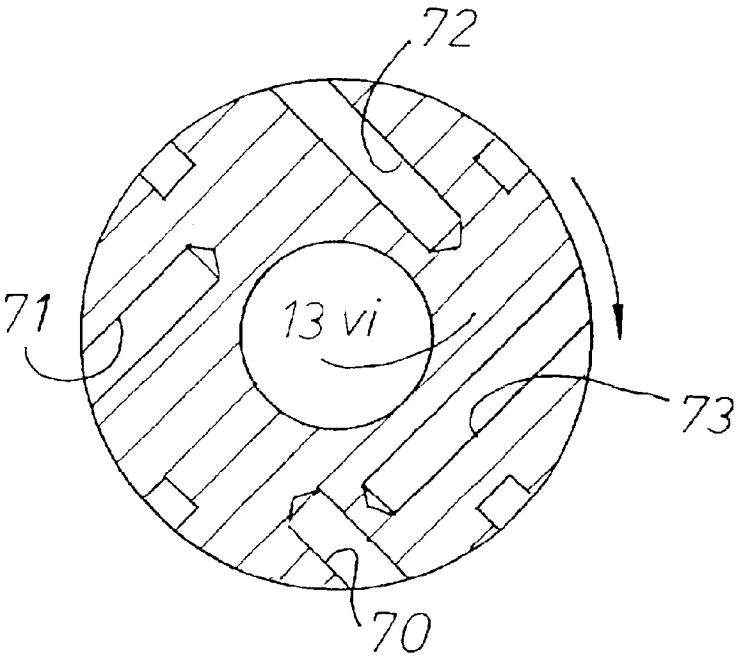
FIG. 15 is exclusively a sectional view for a still further modified rotor to illustrate that such deeply drilled holes in any or all rows may have variable depth.

Furthermore, the depth of holes in a rotor may be varied to suit a particular application, and FIG. 15 illustrates an alternative rotor section 13*vi* where various depth of holes are deployed in a typical row of holes, here for instance shown as four holes 70, 71, 72, 73 of increasing depth. Just as a vibrating tuning fork held over a glass cylinder can cause the column of air inside the cylinder to resonate at the same frequency when the depth of the cylinder is of the appropriate length, the holes of varying depth in this rotor may more readily have the right combination of frequency, wave form and amplitude to cause a further excitation of the water molecules during the general disturbance experienced during cavitation.

Figure 17:
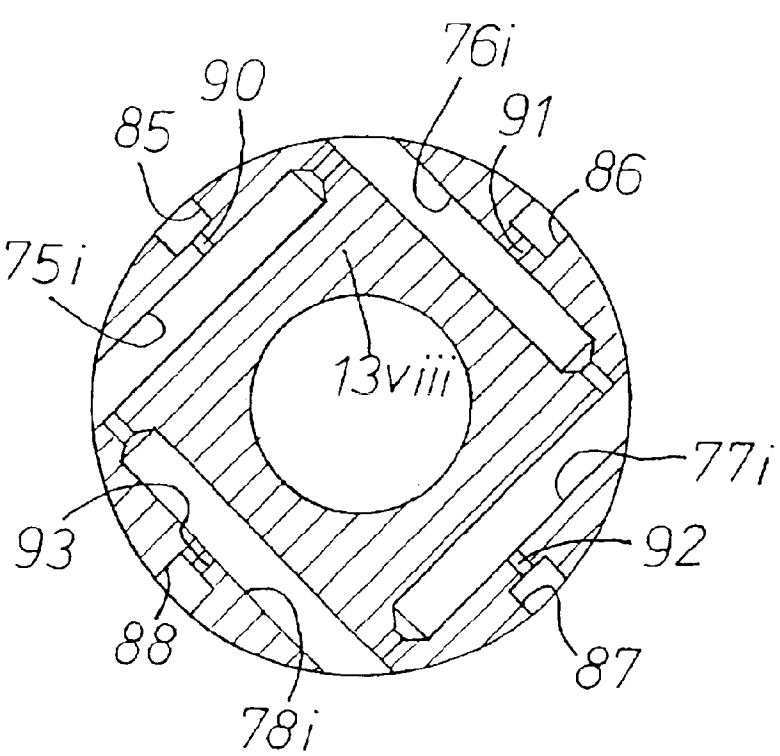
FIG. 17 is exclusively a sectional view for a still further modified rotor to illustrate that such deeply drilled holes may be interconnected with an additional set of relatively shallow depth holes.
Figure 16:
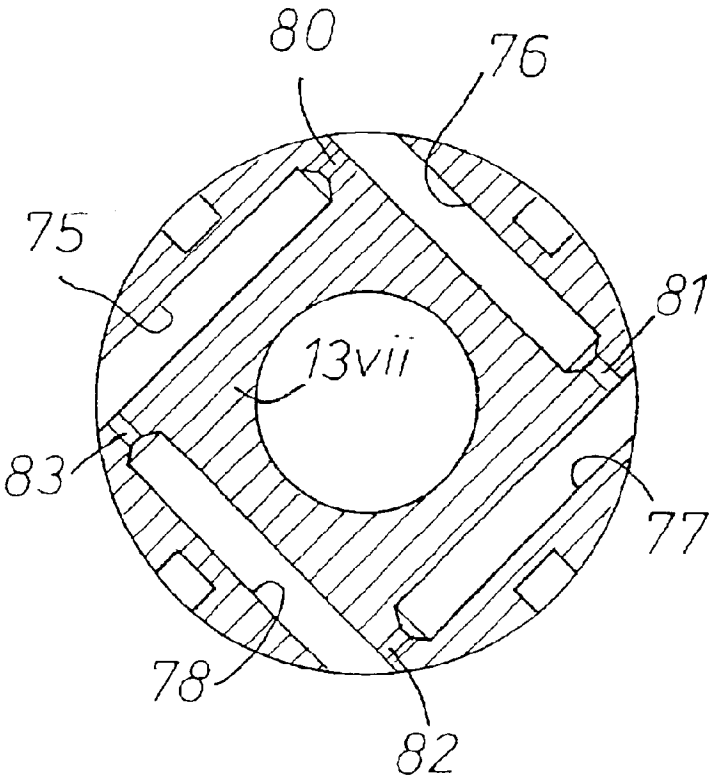
FIG. 16 is exclusively a sectional view for a still further modified rotor to illustrate that such deeply drilled holes may be interconnected.

FIGS. 16 and 17 are further modified rotor sections to exemplify that any set of holes in any particular row of holes may be partially or fully interconnected to heighten the effect from shock waves during the operation of the device. By way of example, FIG. 16 depicts rotor 13*vii* having deep holes 75, 76, 77, 78 which are interconnected by interconnecting passages 80, 81, 82, 83 Although as shown, such passages 80, 81, 82, 83 are of reasonable size to ease the machining operation, they may also be sized much smaller so that they act as throttles to limit the amount of fluid able to transit from, for example, hole 76 to 75 or vice versa.

As a further example, FIG. 17 depicts rotor 13*viii* where shallow pockets 85, 86, 87, 88 are also provided with interconnecting passages, here shown as 90, 91, 92, 93, such pockets 85, 86, 87, 88 have direct connection with their most adjacent holes, here shown as holes 75*i*, 76*i*, 77*i*, 78*i*, respectively.

The previously described rotor configurations have relied on one type or another machining operation to produce the surface detail such as the openings/depression zones, most often by drilling holes. Because in most cases there are a multitude of such holes to be drilled, for certain applications there would be an advantage if the drilling operation could be eliminated. A rotor produced from casting would be a cheaper alternative to a fully machined rotor. The rotor depicted here as FIGS. 18 to 20 is an example of a cast rotor, and for the sake of simplicity, only those components are substantially different to those already described for the earlier embodiment will be denoted with new reference numbers, and description is only necessary to show the main points of difference.

Figure 18:
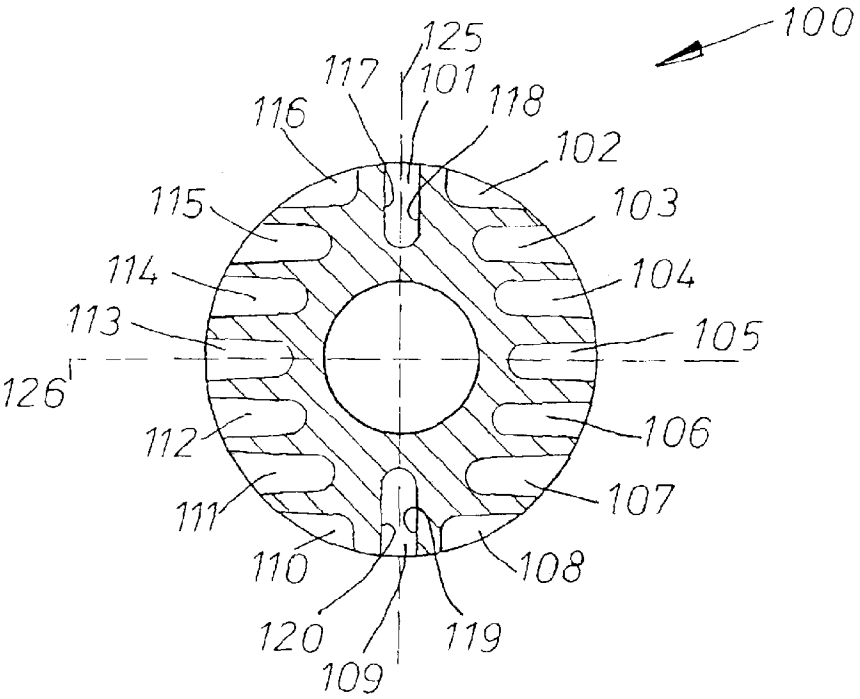
FIG. 18 is exclusively a sectional view of a still further modified rotor to illustrate that openings or depression zones may be formed in a casting.
Figure 19:
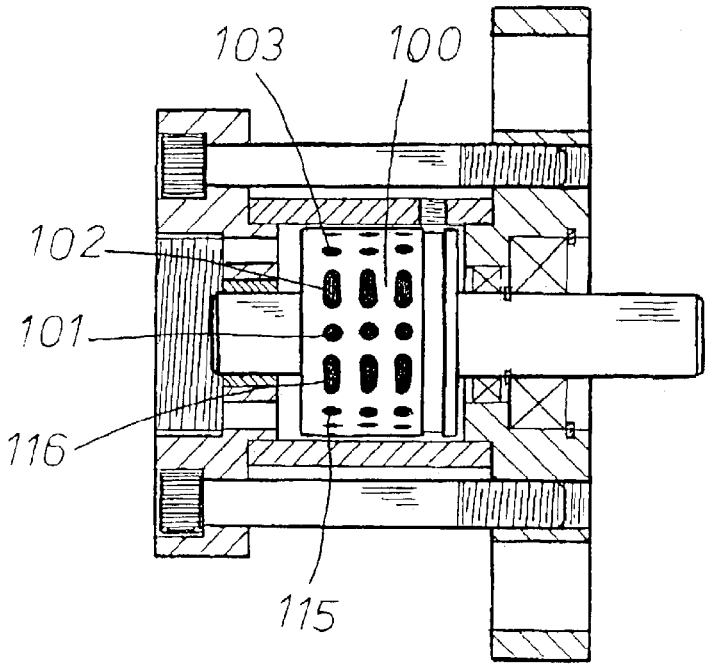
FIG. 19 is a longitudinal sectional view of the heat generating device of FIG. 1. where three rows of openings or depression zones are cast in the rotor by way of example.

A section taken through a typical cast rotor denoted by reference numeral 100 is shown in FIG. 18 depicts one particular row of openings/depression zones. Numbers 101–116 designate each respective opening starting with opening 101 at the top of the rotor 100. Note that opening 109 at the bottom of the rotor 100 is identical to opening 101 in respect that both have generally parallel sides with respect to axis 125, shown as 117, 118 for opening 101 and 119, 120 for opening 109.

In contrast, all other openings in this particular cast rotor, 102–108, and 110–116 are generally aligned with axis 126. Openings 115, 116, 101, 102 and 103 in rotor 100 are visible in the heat generating device of FIG. 19.

Figure 20:
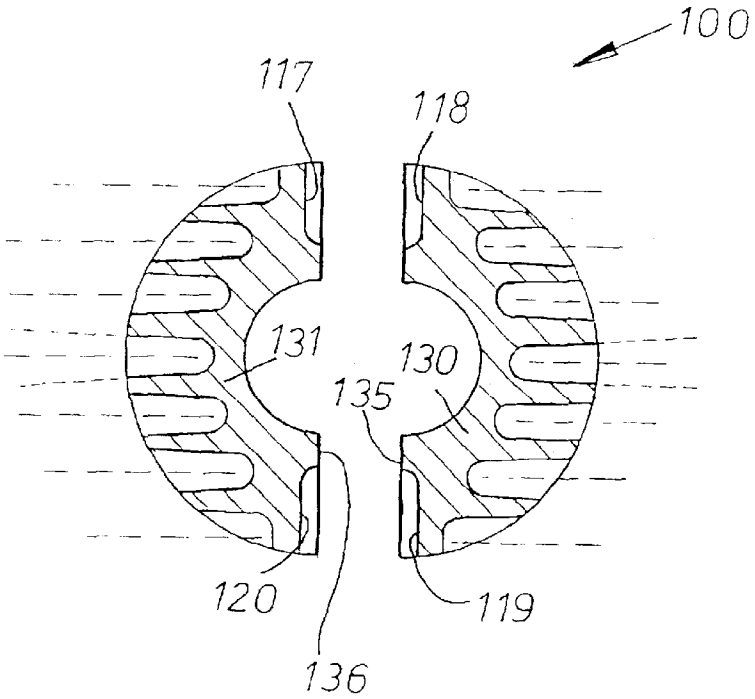
FIG. 20 depicts the cast rotor of FIG. 18 as two separate but identical halves.

In FIG. 20, the rotor 100 is shown as separate identical halves 130, 131 with respective joint surfaces 135, 136, which, once the two halves are together, are coincident with axis 125.

DETAILED DESCRIPTION OF THE SECOND EMBODIMENT OF THE INVENTION

Figure 21:
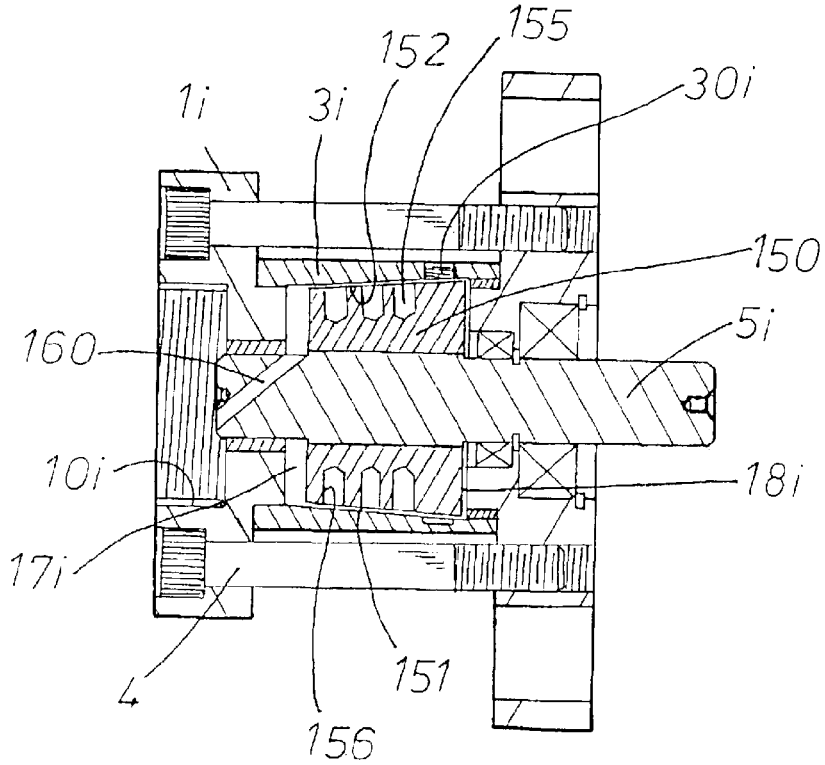
FIG. 21 is a longitudinal sectional view of the heat generating device of FIG. 1. according to a second embodiment of the present invention, deploying a rotor having a 3 degree male tapered cylindrical shape for use in conjunction with a modified central housing sleeve have a complementary female tapered cylindrical bore.

This embodiment of the present invention, depicted in FIG. 21, differs in only two major respects from the previously described first embodiment, firstly, in that the fluid entry connection is now routed through a port in the drive-shaft drive and secondly, the exterior shape of the rotor as well as the opposing interior shape in sleeve housing element are both inclined with respect to the longitudinal axis of the drive shaft.

Rotor 150 fixed to drive shaft 5*i* is provided with a conical male exterior surface 151 and sleeve housing member 3*i* is provided with a complimentary opposing female conical surface 152. As shown, three rows comprising a series of openings or depression zones, here in the formed of drilled holes such as holes denoted by reference numerals 155, 156 are disposed in said rotor 150. Sleeve housing member 3*i* is provided with a fluid exit connection 30*i* whereas the entry connection 10*i* in rear housing member 1*i* in this embodiment is fluidly connected to axial clearance 17*i* at the smaller diameter end of rotor 150 by a port 160 provided in drive shaft 5*i*. Note that axial clearance 18*i* is shorter in axial length than 17*i* on the opposite end of the tapered rotor 150, this also being the case in the earlier embodiments. For purposes of illustration, it should be noted that the longitudinal axis of openings, depicted by hole 155, are inclined with respect to the longitudinal axis of drive-shaft 5*i* (by three degrees), whereas the longitudinal axis of openings, depicted by hole 156, are arranged to be perpendicular to the longitudinal axis of drive-shaft 5*i*. Depicting both types of openings 155 and 156 on the same rotor unit is purely for convenience sake, as a practical matter, the incorporation of both types of openings in the same rotor unit would make the component more expensive to manufacture.

DETAILED DESCRIPTION OF THE THIRD EMBODIMENT OF THE INVENTION

Figure 22:
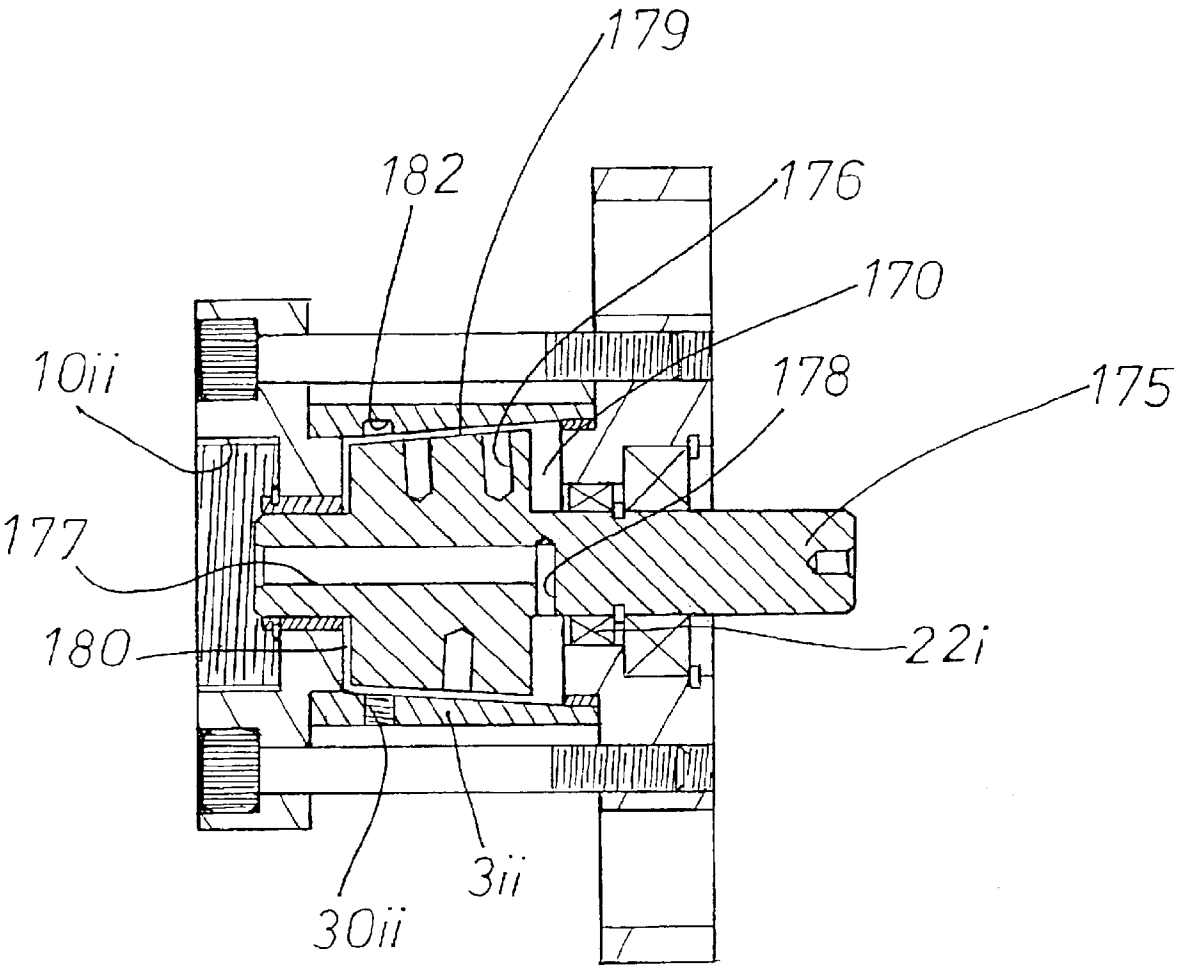
FIG. 22 is a longitudinal sectional view of the heat generating device of FIG. 1. according to a third embodiment of the present invention, deploying a one-piece rotor and shaft component with axial feed port, the outer surface of the rotor being identically tapered in shape as FIG. 21.

This embodiment of the present invention, depicted in FIG. 22, differs in two main respects from the previously described second embodiment. Firstly, the relatively short inclined inlet port at the end of the drive shaft is here replaced by a much longer longitudinal port in the form of a drilled hole which connects with a relatively shorter drilled hole. Secondly, the inlet fluid enters the annular chamber between rotor and housing at the greater diametric dimensioned end of the rotor.

Here one-piece forged rotor and shaft component, here referred to as the rotating component 175. The rotating component carries a plurality of openings 176 and includes a central longitudinal port 177 and radial port 178. The fluid inlet connection 10*ii* communicates through ports 177, 178 to axial clearance 170, and fluid entering axial clearance 180 flows past the various openings 176 in its transit through annular volume between rotating component 175 and housing sleeve 3*ii*. Once reaching circumferential fluid capturing groove 182, in this embodiment show formed in housing sleeve 3*ii* rather than on the surface of the rotor as in the earlier embodiments, the heated fluid is expelled from the device via fluid exit 30*ii*.

Although the outer surface of the 179 rotating component 175 in this embodiment is shown with the same a mount of angle as for the previous embodiment FIG. 18, the outer, surface could equally be parallel cylindrical as shown in the first two embodiments of the invention.

The flow over the outer surface of the rotor in this embodiment, is opposite in direction to the earlier embodiments, being nearer seal 22*i* at axial clearance 170 and moving in a direction towards axial clearance 180. For this reason, and in contrast to the earlier embodiments, axial clearance 170 nearer seal member 22*i* is shown occupying more volume than axial clearance 180.

DETAILED DESCRIPTION OF THE FOURTH EMBODIMENT OF THE INVENTION

Figure 23:
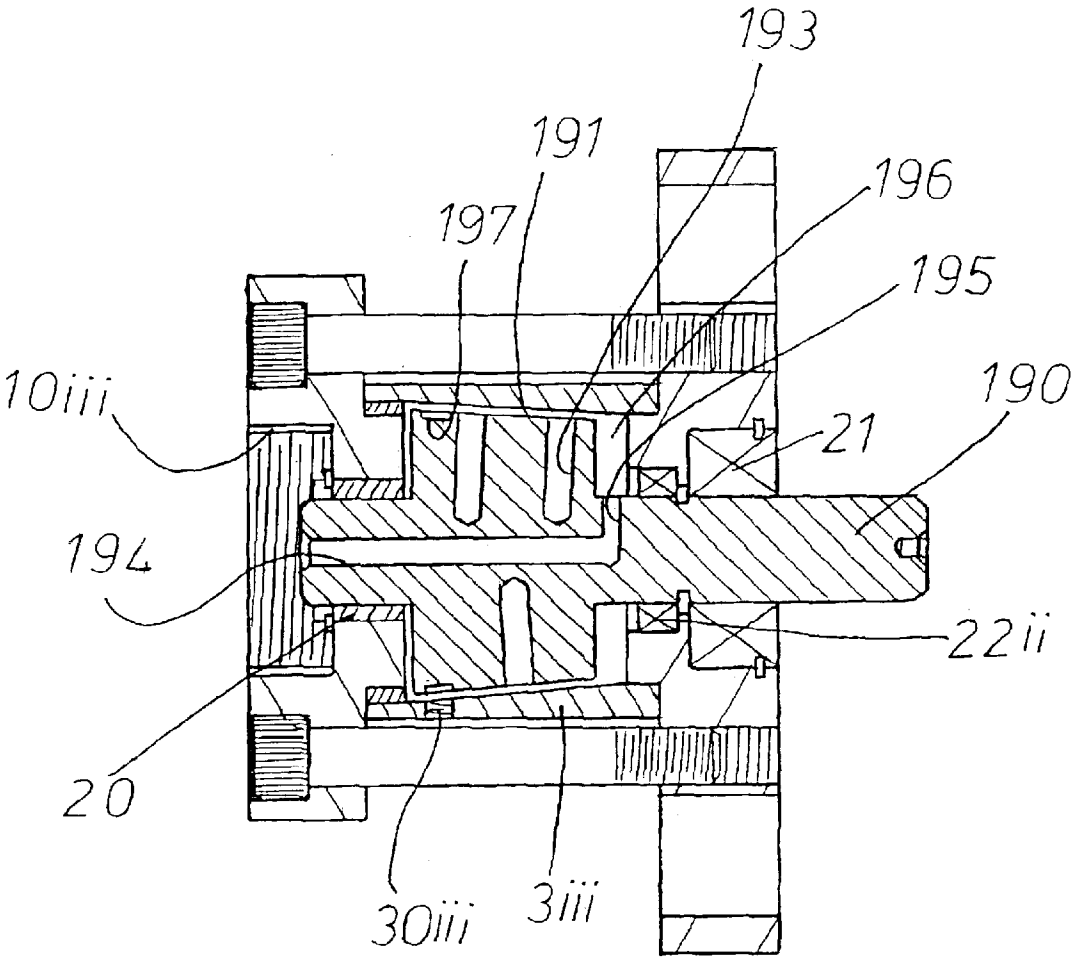
FIG. 23 is a longitudinal sectional view of the heat generating device of FIG. 1. according to a fourth embodiment of the present invention, and where the shape of the rotor includes a 3 degree taper which is opposite in the direction to the inclined rotor of FIGS. 21 and 22.

This embodiment of the present invention, depicted in FIG. 23, differs in one main respect from the previously described third embodiment, namely, the rotating component 190 comprising both the rotor and the drive shaft, is in this instance, provided with an outer surface 191 which is tapered in the opposite direction to the inclined surfaces shown in the second and third embodiments.

Rotating component 190 carries a plurality of openings 193 and includes a central longitudinal port 194 and radial port 195. The fluid inlet connection 10*iii* communicates through ports 194, 195 to axial clearance 196, and fluid entering axial clearance 196 flows past the various openings 193 in its transit through annular volume between rotating component 190 and housing sleeve 3*iii*. Once reaching circumferential fluid capturing groove 197, here reverted back to being located on the outer surface 191 of the rotating component 190, the heated fluid is expelled from the device via fluid exit 30*iii*.

Especially true for both third and fourth embodiments, prior problems experienced with earlier devices, such as susceptibility to suffer from over-heated bearings or seals, is here of far less concern in that the relatively cooler fluid entering the device is communicated via ports in the rotating component to the axial clearance that lies adjacent the seal. In particular, embodiment four has bearings 20, 21 as well placed as is seal 22*ii*, i.e., at a maximum distance from the hottest part of the device, namely adjacent exit connection 30*iii*.

While all embodiments have been shown operating with a fixed clearance gap, the annular chamber, between rotor and housing, those embodiments with inclined or tapered outer surfaces between rotor and housing interior have the added flexibility, if required, unlike the first and second embodiments, to be easily modified allowing the clearance gap to be varied, i.e. increased or decreased to suit the application. When a rotor is given freedom to move axially relative to the housing, the heat-shrink fit connection between drive-shaft and rotor or the one-piece rotating components described in embodiment four and five, would be replaced. For instance, by fitting a male spline on the drive-shaft and a female spline in the rotor, relative movement between the two would occur as the rotor is bodily shifted on the splines.

Although all the embodiments here described rely on circumferential grooves for the collection of the heated liquid or gas from the outer surface of the rotor and axially displaced from the last adjacent row of openings, various advantages of the present invention could equally be applied with good effect to devices having axial end porting for fluid delivery. For instance, the fluid inlet could be arranged to directly communicate with the axial clearance to one side of the rotor. Similarly, various advantages of the present invention could equally be applied with good effect to devices where the fluid inlet is offset from the longitudinal axis of rotation of the rotor/drive shaft. While parallel cylindrical rotors have been described for the first embodiment of the invention, this should not be construed to limit the final embodiments of the present invention to rotors and housings having only inclined confronting surfaces. Equally, the first embodiment could be adapted to operate with rotors and housings having inclined confronting surfaces, or even where only one such surface is inclined, such that the opposing confronting surface remains parallel or differs slightly in the degree of taper from the other surface.

In practical terms, although the above described embodiments show the same sizing of openings or depressions zones for each row, it is not a requirement that they be so standardized. For instance, the rotor may be modified so that a first row of relatively small sized diameter openings with shallow depths is included, with the next adjacent row having openings of increased relative size, and so on, such that the outermost row of openings nearest the fluid exit connection encompass the largest sizing in diameter and depth. Typically, the range of sizes for diameter may range from 10 mm to 50 mm in a 450 mm diameter rotor, although this diameter is not critical and may be varied. The diameter of the rotor itself may be chosen at will depending on the desired application. Although depths may vary, standard depths for all rows of openings are to be preferred for a parallel rotor having drilled radial holes. However, diameters and depths may be chosen to suit each application and the degree of heat output required, whether it be hot water or steam, from a particular machine in question. Typically, the depths of the opening will be greater than diameter, i.e., from about 15 mm to about 280 mm, but it is to be understood that the depth of a given hole may lie in the same range as the diameter. While a circular shape of opening is the most economic shape to produce by drilling in a machined rotor, non circular cross-sections could also be used, for instance by an end mill cutting tool which would also cut non-circular slots or notches over the surface of the rotor. A slitting-saw tool or electro-chemical machining are other options although may prove too slow in practice.

The annular clearance gap between the outer surface of the rotor and the confronting inner surface of the housing being the annular fluid volume for the desired influence by these openings/depression zones, such gap is sized in accordance with achieving the required heat output from the device. The gap is generally rather small in size, especially as a percentage compared to the diameter of the rotor, and most often is only a few millimeters.

As used herein, the term "fluid heating" contemplates the heating of either liquids or gases, although in practice the heating of liquids will be more commonly performed. In the context of heating liquids, it will be expressly understood that the heating device and method according to the invention include not only the generation of a hotter liquid, but also the phase transformation of the liquid into a gas. Therefore, the heat generating device and method as described are also steam generators, wherein the difference between raising the temperature of a liquid versus generating a vapor phase of the liquid may be controlled by the speed of the rotation of the rotor and the design of the cavitation-inducing surface irregularities.

In accordance with the patent statutes, I have described the principles of construction and operation of my invention, and while I have endeavoured to set forth the best embodiments thereof, I desire to have it understood that obvious changes may be made within the scope of the following claims without departing from the spirit of my invention.

What is claimed is:

1. A fluid heating device comprising a housing having an internal chamber;

a fluid inlet and a fluid outlet disposed in said housing and in fluid communication with said internal chamber and each opening exteriorly of said housing;

a rotor mounted for rotation within said internal chamber about an axis of rotation;

said housing having an intermediate portion positioned radially outwardly of said rotor and end portions positioned axially outwardly of opposite faces of said rotor;

a drive shaft rotatably supported in said housing by a pair of bearings and having an inner end disposed in said housing and an outer end disposed outwardly of said housing for receiving power input, said drive shaft imparting mechanical energy to said rotor, and where each of said pair of bearings is disposed in a respective one of said end portions;

a fluid seal disposed in said housing and surrounding said drive shaft, said seal residing in the end portion opposite said fluid inlet, and where said inner end of said drive shaft is exposed to said fluid inlet;

and said rotor comprising an outer surface confronting an inner surface of said intermediate portion and defining an annular fluid volume, said fluid inlet communicating with said annular fluid volume and situated nearer a distal end of said rotor and said fluid cutlet communicating with said annular fluid volume and situated nearer the proximate end of said rotor, said outer surface having a plurality of openings disposed on said outer surface, wherein rotation of said rotor causes said plurality of openings to impart heat-generating cavitation to a fluid entering said internal chamber.

2. The fluid heating device according to claim 1 wherein said axis of rotation intersects said fluid inlet opening exteriorly of said housing.

3. The fluid heating device according to claim 1, and further comprising at least one inlet port disposed in said housing and wherein said fluid inlet is in communication with said internal chamber via said at least one inlet port, said at least one inlet port disposed radially closer to said axis of rotation than said fluid outlet.

4. The fluid heating device according to claim 3 wherein said at least one inlet port lies radially outwardly of one of said pair of bearings.

5. The fluid heating device according to claim 4 wherein said at least inlet one port has its longitudinal axis disposed parallel to said axis of rotation.

6. The fluid heating device according to claim 1, and further comprising at least one inlet port in said drive shaft disposed radially inwardly of one of said pair of bearings and wherein said fluid inlet is in communication with said internal chamber via said at least one inlet port, said at least one inlet port disposed radially closer to said axis of rotation than said fluid outlet.

7. The fluid heating device according to claim 6 wherein said at least one inlet port has its longitudinal axis inclined with respect to said axis of rotation.

8. The fluid heating device according to claim 1, and further comprising at least one inlet port in said drive shaft and disposed radially inwardly of one of said pair of bearings to be radially closer to said axis of rotation than said fluid outlet, and wherein said at least one inlet port has a longitudinal length exceeding the longitudinal length of said rotor.

9. The fluid heating device according to claim 1 wherein said fluid outlet is disposed in said intermediate portion, and further comprising an internal circumferential fluid capturing groove disposed on said inner surface and positioned radially outwardly of said annular fluid volume and axially displaced from said openings, said fluid outlet disposed in said intermediate portion and positioned radially outwardly of said circumferential fluid capturing groove and fluidly communicating with said circumferential fluid capturing groove.

10. The fluid heating device according to claim 1 wherein said fluid outlet is disposed in said intermediate portion, and further comprising an internal circumferential fluid capturing groove disposed on said outer surface and positioned radially inwardly of said annular fluid volume and axially displaced from said openings, said fluid outlet disposed in said intermediate portion and positioned radially outwardly of said circumferential fluid capturing groove and fluidly communicating with said circumferential fluid capturing groove.

11. The fluid heating device according to claim 1 wherein said housing comprises three housing members, said intermediate portion as one housing member, and where respective said end portions are the other housing members.

12. The fluid heating device according to claim 1 wherein said intermediate portion comprises a cylindrical housing sleeve, and where respective end portions comprise rear and front housing covers, said rear and front housing covers each provided with a circular register and said housing sleeve engaging respective registers and clamped between said rear and front housing covers by a plurality of bolts, one of said pair of bearings disposed in said rear housing cover in a position between said internal chamber and said fluid inlet, said seal disposed adjacent the other of said pair of bearings in said front housing cover and exposed to said internal chamber.

13. The fluid heating device according to claim 1 wherein said annular fluid volume provides a unidirectional pathway for fluid entering said internal chamber via said fluid inlet to reach said fluid outlet, and said plurality of openings are disposed in a plurality of circumferential rows spaced about said rotor along the longitudinal axis of said rotor, wherein at least one row of said openings are circumferentially displaced from any one other row of said openings.

14. The fluid heating device according to claim 13, wherein said rotor comprises a casting, and wherein at least a majority of said plurality of openings in said casting are aligned with respect to each other such that their longitudinal axes are disposed in parallel.

15. The fluid heating device according to claim 13 wherein at least some of said openings are formed as radial holes, the longitudinal axes of said radial holes intersecting said axis of rotation.

16. The fluid heating device according to claim 13 wherein at least some of said openings are formed as radial holes, the longitudinal axes of said radial holes offset from said axis of rotation.

17. The fluid heating device according to claim 13 wherein at least some of said openings are formed as blind radial holes, the longitudinal axes of said blind radial holes offset from said axis of rotation, and where the bottom-end of said blind radial holes lags behind the top-end of said radial holes in the direction of rotor travel.

18. The fluid heating device according to claim 13 wherein at least some of said openings are formed as radial holes and where said radial holes have a depth dimension extending the radius dimension of said rotor.

19. The fluid heating device according to claim 13 wherein at least some of said openings are formed as radial holes, the depth of at least some of said radial holes extending in distance to a greater dimension than the radius dimension of said rotor and where said at least some of said radial holes interconnect each other.

20. The fluid heating device according to claim 13 wherein at least some of said openings are formed as radial holes, the depth of at least some of said radial holes extending in distance to a greater dimension than the radius dimension of said rotor and where said at least some of said radial holes interconnect each other forming a continuous pathway in said rotor for the transmission of shock waves.

21. The fluid heating device according to claim 1 wherein said seal and said fluid inlet are disposed directly opposite each other in respective said end portions.

22. A fluid heating device comprising a housing having an internal chamber;

a fluid inlet and a fluid outlet disposed in said housing and in fluid communication with said main chamber and each opening exteriorly of said housing;

a rotor mounted for rotation within said internal chamber about an axis of rotation;

said housing having an intermediate portion positioned radially outwardly of said rotor and end portions positioned axially outwardly of opposite faces of said rotor;

a drive shaft rotatably supported in said housing by a pair of bearings and extending into said internal chamber for imparting mechanical energy to said rotor;

said rotor comprising an outer surface confronting an inner surface of said intermediate portion and defining an annular fluid volume, said fluid inlet communicating with said annular fluid volume and situated nearer a distal end of said rotor and said fluid outlet communicating with said annular fluid volume and situated nearer the proximate end of said rotor, said outer surface having a plurality of openings disposed on said outer surface formed as radial holes having bottom-ends and top-ends with respective longitudinal axes offset from said axis of rotation, and where respective said top-ends or respective said bottom-ends are advanced in the direction of rotor rotation, wherein rotation of said rotor causes said plurality of openings to impart heat-generating cavitation to a fluid entering said internal chamber.

23. The fluid heating device according to claim 22 wherein said radial holes have a depth dimension extending the radius dimension of said rotor.

24. The fluid heating device according to claim 23 wherein said radial holes interconnect with each other forming a continuous pathway in said rotor for the transmission of shock waves.

25. The fluid heating device according to claim 22 wherein said radial holes are blind radial holes disposed in a plurality of circumferential rows spaced about said rotor along the longitudinal axis of said rotor.

26. The fluid heating device according to claim 25 wherein at Least one row of said radial holes are circumferentially displaced from any one other row of said radial holes.

27. The fluid heating device according to claim 22 wherein each of said pair of bearings is disposed in a respective one of said end portions, said drive shaft having an inner end disposed in said housing and an outer end disposed outwardly of said housing for receiving power unit, a fluid seal disposed in said housing and surrounding said drive shaft, said seal residing in the end portion opposite said fluid inlet and where said inner end of said drive shaft is exposed to said fluid seal.

28. The fluid heating device according to claim 22 wherein said housing comprises three members, one of the housing members being said intermediate portion and in the form of a sleeve, and where the other two housing members are the respective end portions in the form of rear and front housing covers, said rear and front housing covers each provided with a circular register and said housing sleeve engaging respective registers and clamped between said rear and front housing covers by a plurality of bolts, one of said pair of bearings disposed in said rear housing cover in a position between said internal chamber and said fluid inlet, said seal disposed adjacent the other of said pair of bearings in said front housing cover and exposed to said internal chamber.

29. The fluid heating device according to claim 22 wherein said housing comprises three members, one of the housing members being said intermediate portion and in the form of a sleeve, and where the other two housing members are the respective said end portions in the form of rear and front housing covers, said rear and front housing covers each provided with a circular register and said housing sleeve engaging respective registers and clamped between said rear and front housing covers by a plurality of bolts, one of said pair of bearings disposed in said rear housing cover in a position between said internal chamber and said fluid inlet, said seal disposed adjacent the other of said pair of bearings in said front housing cover and exposed to said internal chamber.

30. The fluid heating device according to claim 22 wherein said rotation axis intersects said fluid inlet opening exteriorly of said housing.

31. A method of heating fluids, comprising causing a fluid to enter at least one inlet passage of a device comprising a housing having an internal chamber, a rotor mounted for rotation within said chamber about an axis of rotation, said at least one inlet passage and at least one outlet passage formed in said housing and each opening exteriorly of said housing, said at least one inlet passage lying on said rotational axis, said rotor having an exterior surface disposed with at least one circumferential row of openings formed over a substantial part of said exterior surface and confronting a generally cylindrically-shaped interior of said housing to define an annular fluid volume, and rotating said rotor with fluid present in said annular fluid volume at sufficiently fast to cause said openings to impart heat-generating cavitation to a fluid within said chamber.

32. The method according to claim 31, wherein said device further comprises at least three circumferential rows of substantially radially configured blind holes forming said cavitation-inducing openings, wherein respective longitudinal axes of said blind holes are offset from said axis of rotation to advance or retard the commencement of cavitation of the fluid.

33. The method according to claim 31, wherein said device further comprises at least three circumferential rows of radially configured holes forming said cavitation-inducing openings and interconnecting each other to form a continuous pathway for the transmission of shock waves in said openings, and wherein said method further comprising causing fluid to be exposed to a transmission of shock waves created in said continuous pathway.

34. A fluid heating device comprising a housing having an internal chamber, a fluid inlet and a fluid outlet disposed in said housing and in fluid communication with said main chamber, a rotor mounted for rotation within said internal chamber about an axis of rotation, said housing having an intermediate portion positioned radially outwardly of said rotor and end portions positioned axially outwardly of opposite faces of said rotor, said rotor comprising an outer surface confronting an inner surface of said intermediate portion and defining an annular fluid volume, said fluid inlet communicating with said annular fluid volume and situated nearer a distal end of said rotor and said fluid outlet communicating with said annular fluid volume and situated nearer the proximate end of said rotor, said outer surface having a plurality of openings disposed on said outer surface and where said openings are formed as blind radial holes arranged in at least three circumferential rows spaced about said rotor along the longitudinal axis of said rotor, each of said at least three circumferential rows containing an equal number of said blind radial holes per row and where alternate rows are circumferentially displaced from adjacent rows to cause clustering of said at least three circumferential rows within a given axial length of said rotor, wherein rotation of said rotor causes said plurality of blind radial holes to impart heat-generating cavitation to a fluid entering said internal chamber.

35. The fluid heating device according to claim 34 wherein said blind radial holes are formed having bottom-ends and top-ends such that their respective longitudinal axes are offset from said axis of rotation, wherein respective said top-ends or respective said bottom-ends are further advanced in the direction of rotor rotation.

36. The fluid heating device according to claim 34 wherein said blind holes have a depth dimension extending the radius dimension of said rotor.

37. The fluid heating device according to claim 34 wherein at least one of said circumferential rows contains blind holes with respective longitudinal axes disposed at an oblique angle with respect to said longitudinal axis of said rotor.

38. The fluid heating device according to claim 34 wherein said housing comprises three members, one of the housing members being said intermediate portion and in the form of a sleeve, and where the other two housing members are the respective said end portions in the form of rear and front housing covers, said rear and front housing covers each provided with a circular register and said housing sleeve engaging respective registers and clamped between said rear and front housing covers by a plurality of bolts, further comprising a drive shaft rotatably supported in said housing by bearings and extending into said internal chamber for imparting mechanical energy to said rotor, and wherein one of said bearings being disposed in said rear housing cover in a position between said internal chamber and said fluid inlet, another of said bearings being disposed in said front housing cover, a fluid seal disposed in said front housing cover and surrounding said drive shaft, said seal exposed to said internal chamber at the opposite side of said housing where said fluid inlet is located.

39. The fluid heating device according to claim 38 wherein said axis of rotation intersects said fluid inlet.

40. The fluid heating device according to claim 39, further comprising at least one inlet port disposed in said housing and wherein said fluid inlet is in communication with said internal chamber via said at least one inlet port.

41. The fluid heating device according to claim 40 wherein said at least one inlet port lies radially closer to said axis of rotation than to said outer surface of said rotor.

42. The fluid heating device according to claim 40 wherein said at least one inlet port lies radially outwardly of one of said bearings.

* * * * *